US007571687B2

(12) United States Patent
Cornellier

(10) Patent No.: US 7,571,687 B2
(45) Date of Patent: Aug. 11, 2009

(54) APPARATUS FOR DESTRUCTION OF ORGANIC POLLUTANTS

(76) Inventor: J René Cornellier, 361, Chemin des Patriotes, St-Charles sur Richelieu, Quebec (CA) J0H 2G0

( * ) Notice: Subject to any disclaimer, the term of this patent is extended or adjusted under 35 U.S.C. 154(b) by 214 days.

(21) Appl. No.: 11/500,318

(22) Filed: Aug. 8, 2006

(65) Prior Publication Data

US 2008/0039672 A1 Feb. 14, 2008

(51) Int. Cl.
*B08B 9/20* (2006.01)
*F23G 5/12* (2006.01)

(52) U.S. Cl. ..... 110/229; 110/8; 110/119; 110/238; 110/214; 110/341

(58) Field of Classification Search ..... 110/229, 110/238, 341, 214, 14, 224, 246, 295; 55/223
See application file for complete search history.

(56) References Cited

U.S. PATENT DOCUMENTS 3,530,806 A * 9/1970 Bowman ..... 110/212
3,530,906 A 9/1970 Bowman
3,584,609 A 6/1971 Lerner et al.
3,668,839 A 6/1972 Misarek et al.
4,481,891 A * 11/1984 Takeshita et al. ..... 110/238
4,630,553 A 12/1986 Goetzman
4,977,839 A * 12/1990 Fochtman et al. ..... 110/346
4,998,486 A * 3/1991 Dighe et al. ..... 110/346
5,435,258 A 7/1995 Piette
5,908,490 A * 6/1999 Akamatsu et al. ..... 95/113
5,944,034 A * 8/1999 McRae et al. ..... 134/25.4
5,966,467 A * 10/1999 Davies ..... 382/237
5,968,467 A * 10/1999 Karasek ..... 423/240 S
6,619,217 B2 9/2003 Kokubu et al.

OTHER PUBLICATIONS

A. Buckens & H. Huang, '*Comparative evaluation of techniques for controlling the formation and emission of chlorinated dioxins/furans in municipal waste incineration*', Journal of Hazardous Materials 62 (1988), pp. 1-33, Elsevier Science B.V.

* cited by examiner

*Primary Examiner*—Steven B McAllister
*Assistant Examiner*—Nikhil Mashruwala
(74) *Attorney, Agent, or Firm*—Equinox Protection; Franz Bonsang, Patent Agent

(57) ABSTRACT

A mobile destruction apparatus for use with oil contaminated with a toxic organic pollutant material includes a housing, which defines a first heating combustion chamber for heating the oil to generate a toxic fluid using a first burner connected thereto. The apparatus includes a rotating transition cylinder that defines a drying chamber, which is in fluid communication with the combustion chamber to receive the toxic fluid. The cylinder includes an amount of a desiccant material to dry the toxic fluid. A second heating destruction chamber is provided downstream of the cylinder to heat the toxic fluid to substantially convert it and destroy it into an inert fluid, which exhausts from the apparatus. A method of destructing toxic contaminants from contaminated oils is also described.

20 Claims, 3 Drawing Sheets

APPARATUS FOR DESTRUCTION OF ORGANIC POLLUTANTS

FIELD OF THE INVENTION

The present invention concerns apparatuses for destructions of pollutants, more particularly to an apparatus for destructions of persistent organic pollutants (POPs) such as PCB contaminated oil and the like.

BACKGROUND OF THE INVENTION

Disposal of persistent organic pollutants (POPs) such as polychlorinated biphenyls (PCB) contaminated material is an on-going problem for many environmental agencies. Until recently, POP material was disposed of in landfill or destructed. Destruction POP materials such as PCBs is problematic in that toxic side products, namely furan and dioxin are produced, largely because of incomplete combustion of the PCBs. Both disposal processes, however, are unsatisfactory because they release harmful breakdown products into the atmosphere, the soil or into the water table. Clean up of PCB contaminated soil and water supplies is therefore of high importance. One particularly important disposal problem concerns oil that is contaminated with PCBs. PCB contaminated oil has historically been incinerated, but oftentimes the incineration process is incomplete and results in only partial thermal breakdown of the PCB into the aforesaid breakdown products, by destructing only 99.99% of the contaminants. To date no safe and effective disposal method for PCB-contaminated oil is available.

U.S. Pat. No. 5,435,258, issued to Piette on Jul. 25, 1995 for "Method and Apparatus for Regenerating Desiccants" discloses a rotating perforated drum that contains an amount of a contaminated desiccant. The drum rotates with the contaminated desiccant tumbling therein and is subjected to combustion flames playing on its under side, thus burning the oil off the desiccant as the drum rotates. In this instance, the desiccant is the carrier for the contaminant and whilst this simple operation appears to work well for this specific application, it would be inappropriate for use with oil contaminated with PCBs, since the destruction process would be insufficient to destroy the toxic side product of PCB destruction and therefore would release toxic products into the atmosphere. Furthermore, neither the temperature nor the time of combustion would be adequate for the purpose of effecting complete thermal breakdown of the PCB.

Thus there is an urgent need for a safe and efficient apparatus and process for destruction of POPs, including oils contaminated with PCB.

SUMMARY OF THE INVENTION

A principal object of the present invention is to reduce the difficulties and disadvantages of the prior art by providing a novel apparatus and process for destructing oil that is contaminated with liquid PCB or other persistent organic pollutant, to remove 99.9999% of the toxic organic pollutant. Although any organic pollutant could be considered to be destructed by the apparatus of the present invention, the following description will refer to PCB contaminant by way of example only.

Advantageously, the apparatus is of a lightweight design and as such is mobile, which allows destruction of contaminated oil in poorly accessible areas. The apparatus also uses inexpensive recyclable desiccating materials. In addition, the apparatus can destruct large volumes: typically the combustion capacity is of the order of 50 kg/hr, namely one metric tonne per day. The apparatus advantageously provides a three-stage process in which the PCB contaminated oil is first burnt within a burner to vaporize the PCB, which then passes through a second stage wherein the PCB vapor is dried along a drying path defined within a rotating perforate drying drum containing a desiccant. Advantageously, the PCB vapor as it travels along an elongate path of travel is heated to cause substantial thermal breakdown such that the PCB content of the exhaust gases is substantially reduced or essentially eliminated. The third stage involves the use of a conventional burner for generating heat to destroy toxic gases emitted during the combustion and heating process steps.

According to a first aspect of the present invention, there is provided a destruction apparatus for use with an oil feedstock contaminated with a toxic organic pollutant material comprising a housing, a first heating chamber defined within said housing for heating said feedstock in order in use to generate a toxic fluid, a first burner in said first heating chamber for burning off the oil used as first burner fuel, said first heating chamber having a first heating chamber top wall, a first heating chamber bottom wall, and two first heating chamber sidewalls and two end walls, said apparatus further comprises: a second heating chamber for heating said toxic fluid to destroy toxic elements therein, a hollow perforate transition cylinder mounted for rotation between said first heating chamber and said second heating chamber and providing control of a rate of the toxic fluid passing therethrough from the first heating chamber to the second heating chamber, said cylinder being in fluid communication with said first heating chamber to receive said toxic fluid therefrom, said cylinder containing an amount of a discrete particulate absorbent and/or adsorbent material, a second burner in the second heating chamber heating the toxic fluid to substantially convert it into an inert fluid, which inert fluid exiting from the second heating chamber.

Conveniently, the second heating chamber has a toxic fluid inlet opening and an inert fluid outlet opening, said toxic fluid inlet opening being in fluid communication with said first drying chamber to receive said toxic fluid therefrom, said inert fluid outlet opening being spaced apart from said inlet opening to define a fluid pathway, said fluid pathway being of sufficient length so that said second heating chamber heats said toxic fluid for sufficient time to substantially convert it into the inert fluid, which inert fluid exiting through said inert fluid outlet.

Conveniently the first burner is dual fired in the sense that initially upon start-up or at any appropriate time, the fuel feed is a start fuel such as propane the combustion of which elevates the temperature of the first chamber to a predetermined level at which the contaminated oil can be consumed. The contaminated oil itself is fed to the burner once the predetermined temperature level is attained.

The hollow perforate transition cylinder contains an absorbent and/or adsorbent material for filtering out gaseous and particulate products, namely smoke, emanating from the oil combustion in the first heating chamber. The material may be composed of a heat resistant desiccant material such for example as a limestone material commonly known as zeolite, clay band sodium form or molecular sieve or the like. This material may be any suitable size and particulate form, for example the particles may be spherical. The amount of material within the cylinder is selected to ensure that it regulates flow therethrough and that sufficient residence time is afforded for the absorption and/or adsorption. Typically at least a two second residence time is desirable. It will be understood that in use rotation of the cylinder occasions cascading or tumbling of the particulate material giving rise to a turbulent regime thereby increasing the intimate contact between the flowing gases and the particulate emissions to increase filtration and absorption/absorption thereof. The speed of rotation may in practice be varied to modulate the rate of flow of the gases from the heating chamber, but notwithstanding a high rotational speed the material within the cylinder is of sufficient quantity and distribution to ensure that the gases from the heating chamber always pass therethrough. The rotational speed may typically be of the order of between 1 and 30 rpm, typically about 15 rpm, although any speed could be considered depending on the concentration of contaminants in the oil and the destruction rate desired. Furthermore, when the cylinder is at rest, the material therewithin forms a seal to prevent unwanted egress of gaseous and/or particulate emissions from the heating chamber, for example through the rotor mountings.

The heat source in the second heating chamber is conveniently provided by a burner that may preferably be a gas burner, for example a propane gas burner. Other types of fuel may be employed, e.g. natural gas burner or oil. The rate of combustion is selected to ensure that the temperature level is sufficient to achieve the destruction of toxic gases, for example furan and dioxins, arising from the combustion of the PCB contaminated oil. Moreover, the size of the second heating chamber is sufficient to secure that the residence time is also long enough for the destruction of the toxic gases as aforesaid.

The arrangement of the first and second heating chambers and the hollow perforate transition cylinder is such that the path of gases therethrough is substantially serpentine and that accordingly the residence time is always adequate for the stated purposes.

A dry scrubber may be provided downstream of the device to provide a final filter and absorber for any other contaminants, e.g. chloric acid, that might otherwise exhaust from the second heating chamber. This after-filter seeks to ensure that the release of gases into the atmosphere will not give rise to noxious emissions.

It will be understood by the skilled addressee that appropriate sensors and monitoring equipment are provided for the device at suitable dispositions and further that the process will be controlled by a computer program designed for the purpose. A safety system is also embraced within the scope of the present invention and in use ensures that any failure of any aspect of the apparatus will trigger an instantaneous shutdown with all apposite safeguards in accordance with a predetermined operational sequence. Equally, start-up of the apparatus follows a predetermined protocol, viz. inter alia verification of the operation of the controls and the safety system, firing of the burners, attainment of the relevant temperature levels prior to feeding the contaminated oil to the apparatus.

According to a second aspect of the invention, there is provided a method of destructing oil contaminated with at least one organic pollutant, said method comprising the steps of:

maintaining a first heating chamber at a temperature level sufficient to combust the oil, using the contaminated oil as a fuel for a first burner to burn the oil and to vaporize the organic pollutant into the first heating chamber;

controlling of a rate of the products of combustion and the vaporized organic pollutant passing into and along a path defined within a rotating perforate hollow transition cylinder containing an absorbent and/or adsorbent particulate material whereby products of combustion are absorbed and the organic pollutant is dried;

directing the resultant gases into a second heating chamber maintained at a temperature level consistent with the thermal breakdown of the organic pollutant and the destruction of toxic elements therewithin; and exhausting the resultant inert fluid from the second heating chamber.

Preferably a dry scrubber is connected downstream of the second heating chamber to clean the resultant inert fluid further to remove any remaining toxic elements that may give rise to noxious emissions contrary to legal limits.

The temperature at which the first heating chamber is maintained is advantageously of the order of between 600° C. to 1000° C., and typically about 850° C. The maximum capacity for the first burner is typically 2.5 MBTU/hr for a relatively small mobile apparatus just fitting on a single trailer for easy displacement thereof. Obviously, the required burner capacity depends on the volume of contaminated oil and the destruction rate.

The combustion capacity of the oil feed to the first heating chamber may be of the order of 50 kg/hr, approximately 1 tonne per day, for a small mobile apparatus.

Conveniently the device is mountable upon a low-loader with a traction unit attachable thereto, thus rendering the device mobile.

BRIEF DESCRIPTION OF THE DRAWINGS

Further aspects and advantages of the present invention will become better understood with reference to the description in association with the following figures, wherein.

DETAILED DESCRIPTION OF THE PREFERRED EMBODIMENTS

Figure 1:
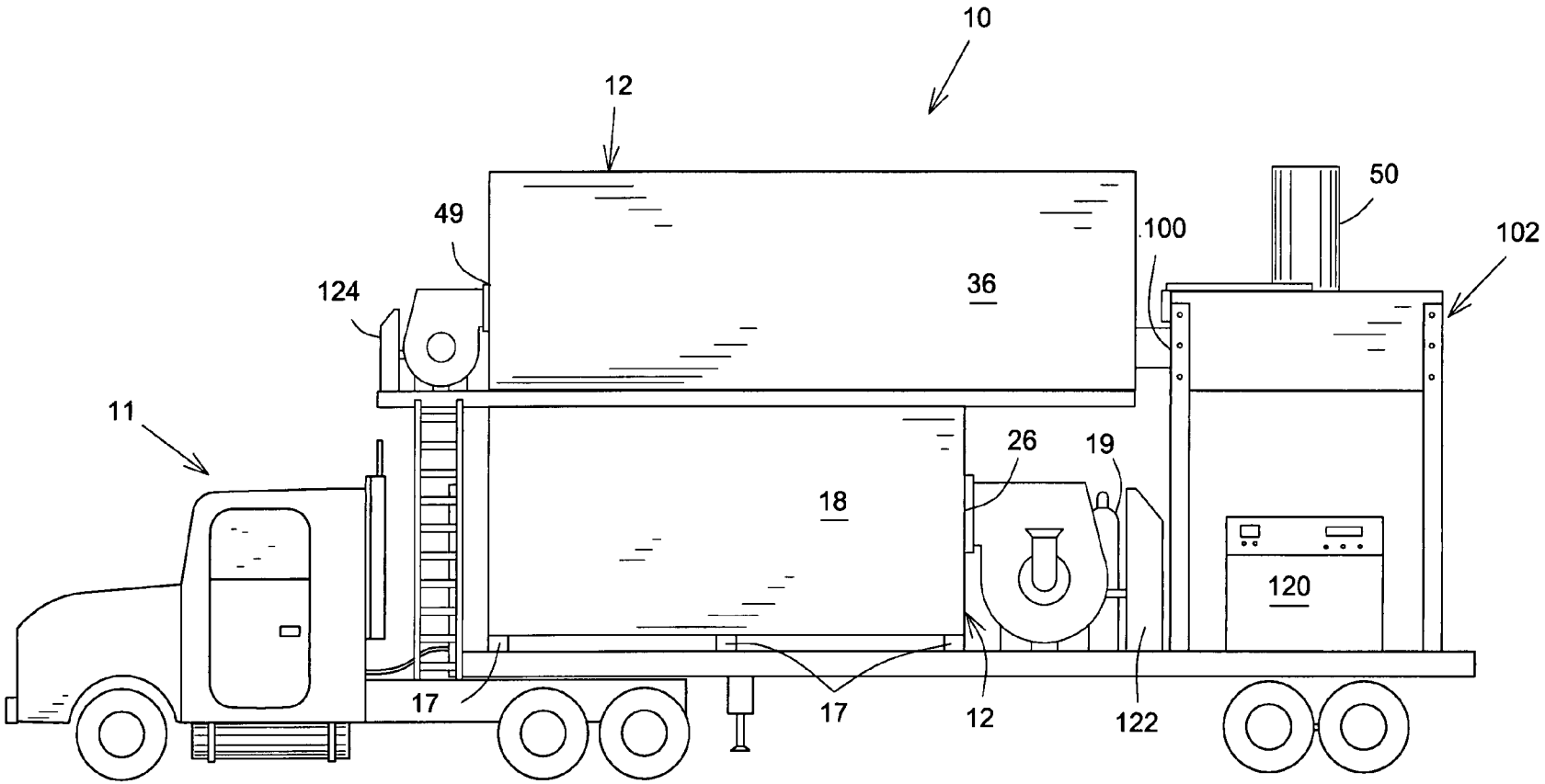
FIG. 1 is an external view of a destruction apparatus for contaminated oil in accordance with an embodiment of the present invention shown mounted on a transport unit.

Referring first to FIG. 1, there is illustrated diagrammatically a destruction apparatus 10 mounted on a transporter 11 with a dry scrubber unit 102 connected to the outlet of the apparatus and having a chimney 50 for discharge of contaminant free gases into the atmosphere.

Referring to the Figures, there is shown generally at 10 a destruction apparatus for use with oil contaminated with a toxic organic pollutant material. The apparatus 10 includes a housing 12 provided with support feet 17. Although the present pollutant destruction apparatus 10 can be used to destruct any toxic persistent organic pollutant material contaminating oil or the like, the following description refers only to polychlorinated biphenyls (PCB) contaminant for simplicity and by way of example only.

The housing 12 defines a first heating or combustion chamber 18 for heating the oil in order to generate a toxic fluid. The combustion chamber 18 is typically a generally rectangular box structure and includes a top wall 20, a bottom wall 22, and sidewalls 24 and end walls 21. The top wall 20 includes a hole 23 therein, the purpose of which is described below. A first burner 26 is located in one end wall 21 of the combustion chamber 18 and is in use fed with a gas, e.g. propane, on start-up and then the contaminated oil once the appropriate oil combustion temperature has been attained.

A rotatable perforate transition cylinder 14 is suitably mounted on an axle 28 to the sidewalls 24 and is rotatable by a motor (not shown). The cylinder 14 is typically mounted at an upper part of the combustion chamber 18 towards its end remote from the burner 26 and rotates in a sealing engagement with the sidewalls 24, an end wall 21 and depending baffle wall 21'. The sealing engagement forces the PCB vapor into a drying chamber 30 defined with the cylinder 14 and into substantial contact with an amount of desiccating material 32 that is contained in the drying chamber 30. The cylinder 14 has a longitudinal axis 34, which is generally parallel to the ground and laterally of the combustion chamber 18. The desiccating material 32 is preferably of an amount which fills the drying chamber 30 to about half its capacity, typically near to the axle 28.

The perforations in the transition cylinder 14 allow the PCB vapor to travel from the combustion chamber 18 to the drying chamber 30. As the drum 14 rotates, the desiccant material 32 tumbles and exposes a maximum surface area to the PCB vapor. The desiccant material 32 is used to substantially remove water vapor from the PCB vapor and is preferably of a granular material with a high surface area. Preferably the desiccant material 32 is a material known to those skilled in the art and could be molecular sieves, silicon oxide, aluminum oxide, magnesium oxide, clay band sodium form or the like. More preferably, the desiccant material is a limestone material commonly known as zeolite.

A second heating chamber or destruction chamber 36, which heats the dried PCB vapor to a second temperature, is formed above the combustion chamber 18 and includes a top wall 38, a bottom wall 40, sidewalls 42 and end walls 41. The bottom wall 40 includes a hole 44, which is connected to the combustion chamber hole 23 and forms a toxic fluid inlet opening 46 for providing passage for the dried PCB vapor from the drying chamber into the destruction chamber 36. The walls of both the combustion chamber 18 and the destruction chamber 36 are typically made from a heat resistant material, such as refractory. The housing 12 typically includes a shell 47, which encases the combustion chamber 18 and the destruction chamber 36. The apparatus 10 is typically constructed from materials that are sufficiently lightweight to enable the apparatus 10 to be portable.

A second burner 49 is provided in the end wall 41 of the destruction chamber 36 adjacent the hole 44 near the toxic fluid inlet 46 and directs heat into the destruction chamber 36 to heat it to the second temperature. Preferably, the second temperature is about 1200° C. The burner is preferably a gas burner for burning for example propane supplied in pressurized cylinder or container 19 via feed lines 19*a* and 19*b*.

Located away from the toxic fluid inlet opening 46 is an inert fluid outlet opening 48, which is typically a duct 50' that is connected through an end wall 41 to the inlet 100 of a dry scrubber 102. The openings 46 and 48 and the length of the destruction chamber 36 define a path of travel for the dried PCB vapor to travel along when it exits the drying chamber 30. The path of travel is of a sufficient length such that the dried PCB vapor, as it travels along it, is heated by the combustion gases of the second burner 49 at the second temperature for a time which is sufficient to cause thermal breakdown and destruction of the PCB into inert, non-toxic breakdown products. Typically, the breakdown products include inert, non-toxic gases such a carbon dioxide, sulfur dioxide, carbon monoxide and hydrogen chloride, which exit the destruction chamber 30 though the exhaust duct 50'. If desired, the exhaust duct 50' is connected to the scrubber 100 for further processing for filtration and to remove chloric acid.

Operation

The operation of the apparatus 10 will now be described. For start-up of the apparatus, an operator ignites the burner 26 which at this initial stage is fed with for example propane from a reservoir and directs flames into the combustion chamber 18. The burner continues to function on propane gas until the operating temperature of the combustion chamber is reached, for example 850° C., at which point the feed of contaminated oil to the burner is initiated and the feed of propane is discontinued.

The motor (not shown) is activated so that the cylinder 14 rotates and the second burner 49 is turned on with a temperature target in the region of 1200° C. When the oil is destructed, the PCB vaporizes and travels upwards into the rotating drum 14 through the perforations therein. The desiccant material 32 absorbs water vapor from the PCB vapor; the dried PCB vapor thereafter moving further upwardly though the toxic fluid inlet opening 46 into the destruction chamber 36. The desiccant material is in discrete particulate form and during the rotary motion of the cylinder tumbles or cascades and thus affords intimate contact with the smoke, i.e. gases and particulates arising from the combustion of the oil. The desiccant material also filters the smoke whilst also drying the PCBs. The speed of rotation of the cylinder assists in the control of smoke throughput and accordingly the faster the speed the greater the flow rate of smoke. When the cylinder ceases to rotate the desiccant particles serve as a seal with the containing walls of the apparatus to prevent the escape of any toxic gases or vapor.

The second burner 49 then provides heat for the PCB vapor as it travels into the destruction chamber along the path of travel for sufficient time to cause about 99.9999% thermal decomposition and destruction of the PCB into the inert, non-toxic gases, which then exit the second container.

Figure 2:
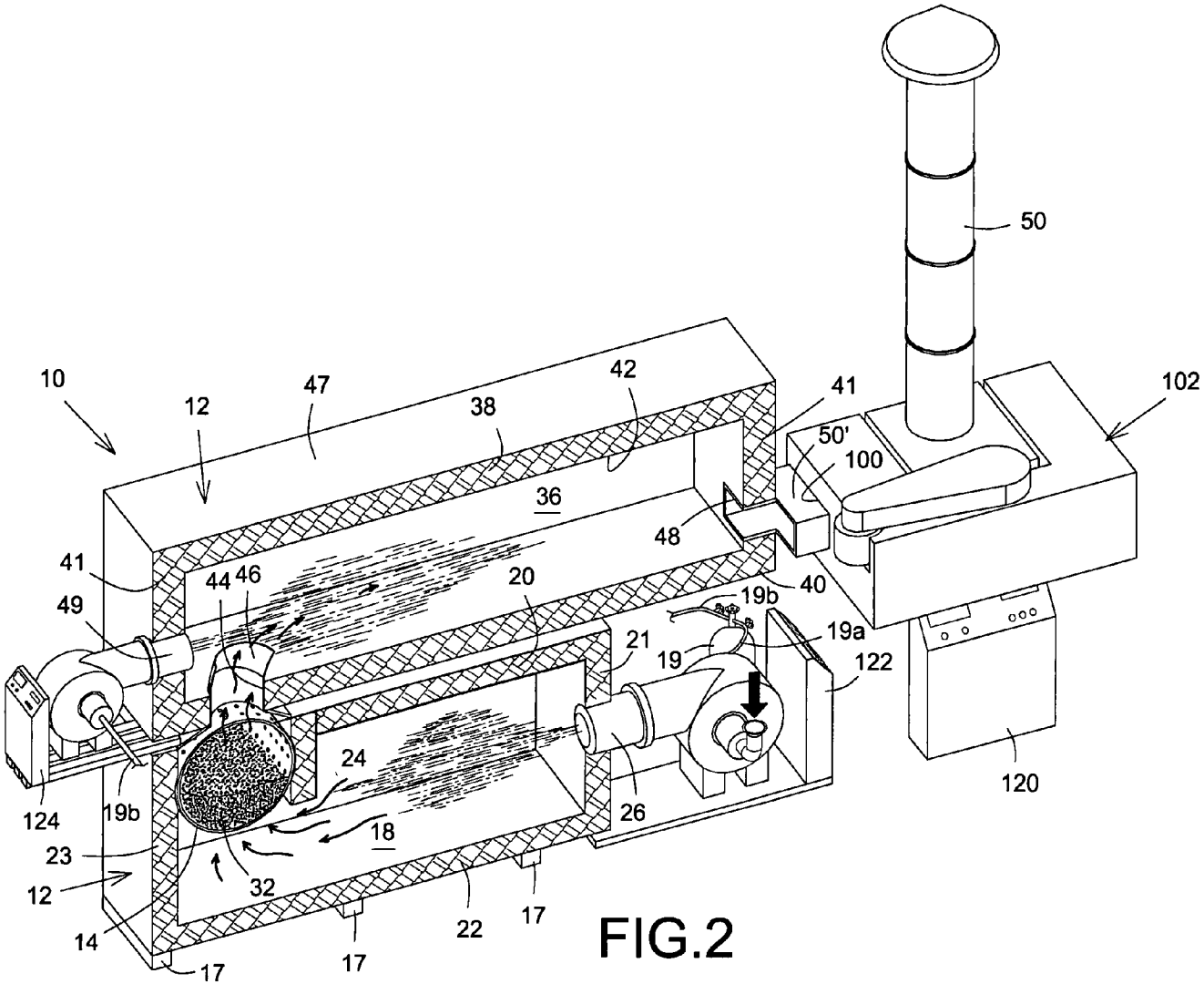
FIG. 2 is a longitudinal cross section view of the destruction apparatus.
Figure 3:
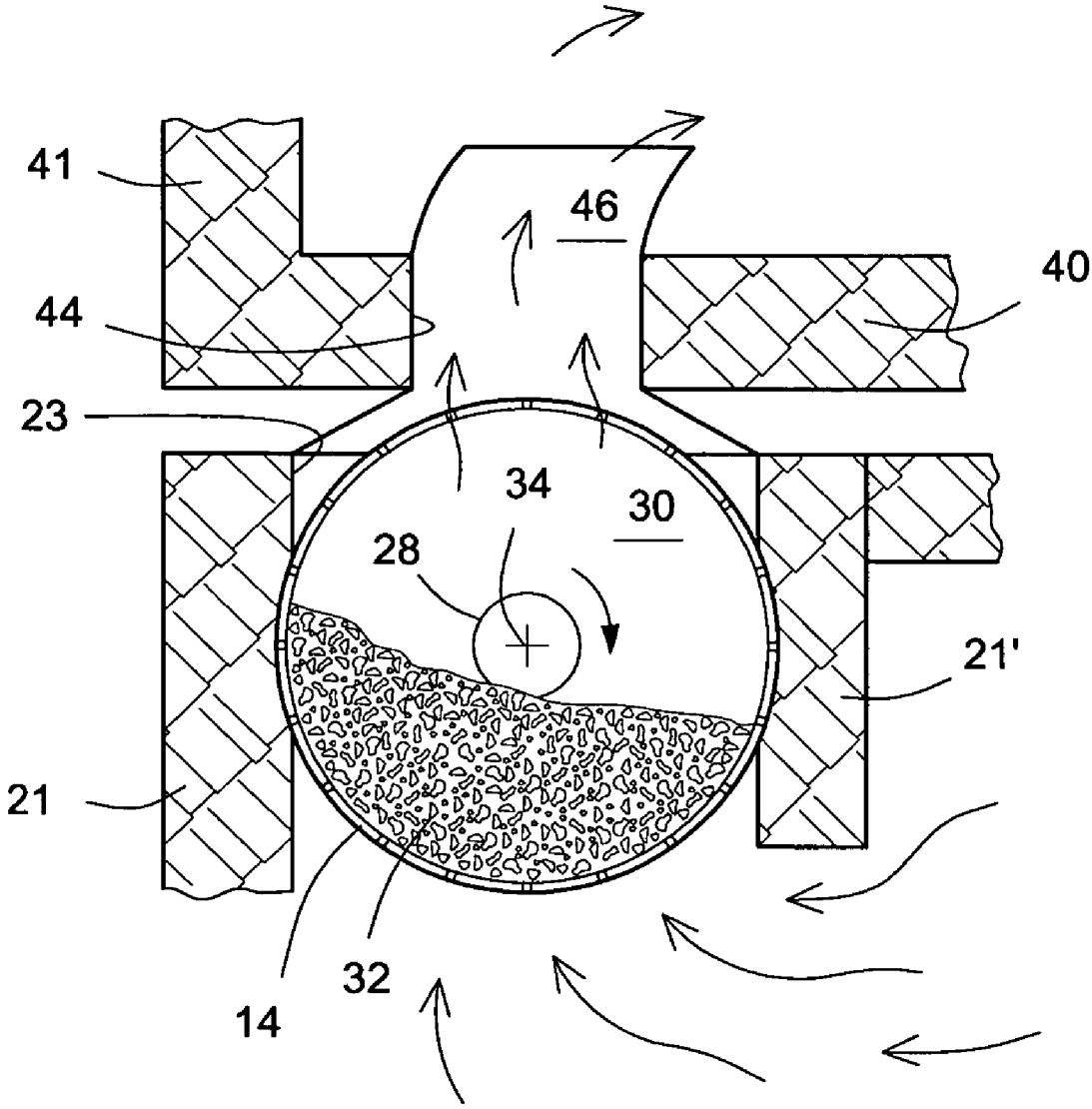
FIG. 3 is a fragmentary end view of a detail of the destruction apparatus.

The path of the gases through the apparatus is shown by the arrows in FIG. 2.

After continued use, the desiccant material 32 may be recycled or replaced.

It will be understood that all aspects of the process herein described are in practice closely monitored to ensure compliance with currently prevailing statutory regulations concerning toxic emissions and of course to secure efficient operation. In particular, temperature sensors and analytical probes are strategically placed within the crucial operation regions of the apparatus and monitoring equipment is provided to display and record performance values. For example sensors for CO, $CO_2$ and $O_2$ are sited as required at various locations to record relevant concentrations and values are displayed as aforesaid. Control of the apparatus is effected by computer programming and naturally as hereinbefore indicated safety criteria are in-built to secure that when any potentially dangerous circumstances arise the apparatus is shut-down in an orderly fashion in accordance with a preset protocol. In like manner, the start-up procedure outlined supra also follows a protocol to ensure that appropriate and predetermined parametric conditions are fulfilled.

Control panels 120, 122, and 124 for the process generally, and the burners are shown diagrammatically in FIG. 2.

Although the present invention has been described with a certain degree of particularity, it is to be understood that the disclosure has been made by way of example only and that the present invention is not limited to the features of the embodiments described and illustrated herein, but includes all variations and modifications within the scope and spirit of the invention as hereinafter claimed.

I claim:

1. A destruction apparatus for use with an oil feedstock contaminated with a toxic organic pollutant material comprising a housing, a first heating chamber defined within said housing for heating said feedstock in order in use to generate a toxic fluid, a first burner in said first heating chamber for burning off the oil used as a first burner fuel, said first heating chamber having a first heating chamber top wall, a first heating chamber bottom wall, and two first heating chamber sidewalls and two end walls, said apparatus further comprising: a second heating chamber for heating said toxic fluid to destroy toxic elements therein, a hollow perforate transition cylinder mounted for rotation between said first heating chamber and said second heating chamber and varying a rate of said toxic fluid passing therethrough from said first heating chamber to said second heating chamber, by varying the speed of the rotation of said transition cylinder said cylinder being in fluid communication with said first heating chamber to receive said toxic fluid therefrom, said cylinder containing an amount of a discrete particulate absorbent and/or adsorbent material, a second burner in the second heating chamber heating the toxic fluid to substantially convert it into an inert fluid, which inert fluid exiting from the second heating chamber, wherein the first burner and transition cylinder are located so as to combust the oil outside of said transition cylinder.

2. The apparatus according to claim 1 wherein the second heating chamber has a toxic fluid inlet opening and an inert fluid outlet opening, said toxic fluid inlet opening being in fluid communication with said first drying chamber to receive said toxic fluid therefrom, said inert fluid outlet opening being spaced apart from said inlet opening to define a fluid pathway, said fluid pathway being of sufficient length so that said second heating chamber heats said toxic fluid for sufficient time to substantially convert it into the inert fluid, which inert fluid exiting through said inert fluid outlet.

3. The apparatus according to claim 1 wherein the first burner is dual fired.

4. The apparatus according to claim 1 wherein the absorbent material is a limestone material.

5. The apparatus according to claim 3 wherein the material is zeolite.

6. The apparatus according to claim 1 wherein the absorbent material is in the form of discrete spheres.

7. The apparatus according to claim 1 wherein the absorbent material half fills the interior of the transition cylinder.

8. The apparatus according to claim 1 wherein the speed of rotation of the transition cylinder is variable.

9. The apparatus according to claim 8 wherein the speed of rotation of the transition cylinder is approximately between 1 and 30 rpm.

10. The apparatus according to claim 9 wherein the speed of rotation of the transition cylinder is approximately 15 rpm.

11. The apparatus according to claim 1 wherein the particulate absorbent and/or adsorbent material forms a seal with the walls of the apparatus within the first heating chamber.

12. The apparatus according to claim 1 wherein the second burner is a gas burner.

13. The apparatus according to claim 1 wherein the second heating chamber supermounts the first heating chamber.

14. The apparatus according to claim 2 wherein the second burner is adjacent the toxic fluid inlet thereto.

15. The apparatus according to claim 1 wherein the first heating chamber, the transition cylinder and the second heating chamber provide a serpentine path in use for gases to follow.

16. The apparatus according to claim 1 wherein the transition cylinder is disposed with its axis of rotation transverse to the first and second chambers.

17. A method of destructing oil contaminated with at least one organic pollutant, said method comprising the steps of:

maintaining a first heating chamber at a temperature level sufficient to combust the oil, using the contaminated oil as a fuel for a first burner into said first heating chamber to burn the oil and to vaporize the organic pollutant into said first heating chamber;

directing the products of combustion into a rotating perforated hollow transition cylinder;

controlling of a rate of the products of combustion and the vaporized organic pollutant passing into and along a path defined within the rotating perforate hollow transition cylinder containing an absorbent and/or adsorbent particulate material whereby products of combustion are absorbed and the organic pollutant is dried; wherein the rate is controlled by varying the speed of rotation of said transition cylinder directing the resultant gases into a second heating chamber maintained at a temperature level consistent with the thermal breakdown of the organic pollutant and the destruction of toxic elements therewithin; and exhausting the resultant inert fluid from the second heating chamber.

18. A method according to claim 17 wherein a dry scrubber is connected downstream of the second heating chamber to clean the resultant inert fluid.

19. A method according to claim 17 wherein the temperature at which the first heating chamber is maintained during use is of the order of 850° C.

20. A method according to claim 17 wherein the temperature at which the second heating chamber is maintained is of the order of 1200° C.

* * * * *